US006259194B1

(12) United States Patent
Ito et al.

(10) Patent No.: US 6,259,194 B1
(45) Date of Patent: Jul. 10, 2001

(54) SHADOW MASK TYPE COLOR CATHODE RAY TUBE HAVING A SHADOW MASK WITH CURLS THEREOF REDUCED

(75) Inventors: Hiroshi Ito; Nobuhiko Hosotani, both of Mobara; Mitsuru Watanabe, Chousei-gun; Haruhiko Yoshida, Sakura, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/339,905

(22) Filed: Jun. 25, 1999

(30) Foreign Application Priority Data

Jun. 26, 1998 (JP) ..... 10-180945

(51) Int. Cl.[7] ..... H01J 29/80

(52) U.S. Cl. ..... 313/408; 313/402; 313/403; 313/404; 313/407

(58) Field of Search ..... 313/408, 402, 313/403, 404, 407

(56) References Cited

U.S. PATENT DOCUMENTS

| | | | |
|---|---|---|---|
| 3,585,431 | 6/1971 | Long | 313/407 |
| 3,855,493 | 12/1974 | Snook et al. | 313/402 |
| 4,146,816 | 3/1979 | Morrell | 313/407 |
| 4,437,036 | 3/1984 | Ragland, Jr. | 313/402 |

FOREIGN PATENT DOCUMENTS

| | | |
|---|---|---|
| 26 02 240 A1 | 7/1977 | (DE) . |
| 0 881 658 A1 | 12/1998 | (EP) . |
| 0 895 271 A1 | 2/1999 | (EP) . |
| 2 134 436 | 4/1972 | (FR) . |
| 2 238 423 | 5/1991 | (GB) . |
| 60-40941 | 3/1985 | (JP) . |
| 3-76352 | 7/1991 | (JP) . |
| 4-95334 | 3/1992 | (JP) . |
| 6-044919 | 2/1994 | (JP) . |
| 6-349415 | 12/1994 | (JP) . |
| 8-96726 | 4/1996 | (JP) . |

*Primary Examiner*—Vip Patel
*Assistant Examiner*—Kevin Quarterman
(74) *Attorney, Agent, or Firm*—Antonelli, Terry, Stout & Kraus, LLP

(57) ABSTRACT

A color cathode ray tube includes an evacuated envelope having a panel portion, a neck portion, and a funnel portion for connecting the panel portion and the neck portion, a generally rectangular shadow mask having a curved apertured portion having a multiplicity of electron-transmissive apertures, a curved imperforate portion surrounding and integral with the apertured portion and a peripheral skirt portion, a generally rectangular support frame for suspending the shadow mask by spot welding the peripheral skirt portion thereto, within said panel portion, a phosphor screen formed on an inner surface of the panel portion, an electron gun housed in the neck portion, and a deflection yoke. The shadow mask is provided with a descending step portion extending along an outer edge of the imperforate portion, the peripheral skirt portion is formed by being bent back from an outer edge of the descending step portion, and the peripheral skirt portion is provided with a plurality of beads extending in a direction of a height of the peripheral skirt portion and protruding inward in each side of the peripheral skirt portion.

24 Claims, 5 Drawing Sheets

SHADOW MASK TYPE COLOR CATHODE RAY TUBE HAVING A SHADOW MASK WITH CURLS THEREOF REDUCED

BACKGROUND OF THE INVENTION

The present invention relates to a shadow mask type color cathode ray tube, and more particularly to a shadow mask type color cathode ray tube provided with a shadow mask free from occurrence of deformation and reduction in mechanical strength of its apertured portion when the skirt portion of the shadow mask is fitted in its support frame, by reducing curls occurring in the skirt portion of the press-formed shadow mask.

Generally, a color cathode ray tube has a phosphor screen formed on an inner surface of a faceplate of a panel portion of an evacuated envelope, a shadow mask closely spaced from the phosphor screen and suspended within the panel portion, an in-line type electron gun housed in a neck portion of the evacuated envelope, a deflection yoke mounted around a funnel portion of the evacuated envelope.

In operation, three electron beams projected from the in-line type electron gun are deflected in desired directions, pass through one of a large number of electron beam apertures in the shadow mask and impinge upon phosphor picture elements of the corresponding colors of the phosphor screen, respectively, to produce a desired color image on the phosphor screen.

The shadow mask used in the prior art color cathode ray tube has a generally rectangular apertured portion having a large number of electron beam apertures, a generally rectangular window-frame-like imperforate portion surrounding and integral with the apertured portion and a skirt portion bent back from a periphery of the imperforate portion, and the apertured portion, the imperforate portion and the skirt portion are integrally press-formed. The skirt portion is fitted into a support frame and is spot welded at its fitted portions to the support frame to form a shadow mask assembly. The support frame is fixed to the inner sidewall of the panel portion such that the shadow mask opposes the phosphor screen.

FIGS. 4A to 4C illustrate the structure of an example of a prior art shadow mask for a color cathode ray tube, FIG. 4A being a plan view, FIG. 4B being a perspective view of weld points and their vicinities in the skirt portion and FIG. 4C being across-sectional view of a portion of the shadow mask ranging from the imperforate portion to the skirt portion. In FIGS. 4A to 4C, reference numeral 41 denotes the shadow mask, 42 is the apertured portion, 43 is the imperforate portion, 44 is the skirt portion and X marks indicate weld points.

The shadow mask 41 has a large number of electron beam apertures (not labeled), a generally rectangular and curved apertured portion 42, a generally rectangular window-frame-like imperforate portion 43 surrounding and integral with the apertured portion 42 and having a curvature in cross section similar to that of the apertured portion 42, and a skirt portion 44 bent back from a periphery of the imperforate portion 43, and the apertured portion. Usually the apertured portion 42, the imperforate portion 43 and the skirt portion 44 are integrally formed by press-forming a thin sheet metal mask blank having the apertured portion.

The mask blank having an apertured portion is very thin and relatively weak in mechanical strength, and therefore the shape of the press-formed shadow mask 41 is not necessarily satisfactory. Especially, since the skirt portion 44 is formed by being bent back at approximately right angles from the periphery of the imperforate portion 43, the skirt portion 44 of the shadow mask 41 curls outwardly by a maximum distance S from a straight line passing through a bend line between the imperforate portion 43 and the skirt portion 44 and parallel to the longitudinal axis of the cathode ray tube, in a region centering about the center of each side of the generally rectangular shadow mask 41, as shown in FIG. 4C.

The press-formed shadow mask 41 is fixed by fitting its skirt portion 44 into the support frame (not shown) and then spot welding the skirt portion 44 to the support frame at several points. The weld points of the skirt portion 44 and the support frame are distributed two approximately at the center of each long side, two approximately at the center of each short side, and one at each corner of the shadow mask 41, for example, as indicated by X marks in FIG. 4B.

As explained above, in the case of the prior art shadow mask 41, occurrence of curls in the skirt portion 44 could not be avoided when the mask blank is press-formed into a unitary mask structure. If the maximum size S of curls is excessive, problems in that it becomes difficult to fit the skirt portion 44 into the support frame and also difficult to subsequently spot weld the fitted parts of the skirt portion 44 to the support frame, resulting in the degradation of workability in fixing the shadow mask 41 to the support frame.

Also in the case of the prior art shadow mask 41, if the skirt portion 44 having curls of the excessive maximum size S is forced to fit into the support frame, stress caused to the skirt portion 44 is transmitted to the apertured portion 42 via the imperforate portion 43, and consequently the curvature of the apertured portion 42 is sometimes deformed and color selecting property of the shadow mask 41 is deteriorated, and also the mechanical strength of the shadow mask 41 is reduced.

SUMMARY OF THE INVENTION

The present invention was made against such technical background, and it is one of the objects of the present invention to provide a color cathode ray tube provided a shadow mask capable of improving workability in the operation of fitting the skirt portion of the shadow mask into the support frame and capable of preventing deformation of the curvature of the apertured portion of the shadow mask by reducing the size of curls occurring in the skirt portion.

To accomplish the above object, a color cathode ray tube of an embodiment in accordance with the present invention comprises an evacuated envelope comprising a panel portion, a neck portion, and a funnel portion for connecting the panel portion and the neck portion, a generally rectangular shadow mask having a curved apertured portion having a multiplicity of electron-transmissive apertures, a curved imperforate portion surrounding and integral with the apertured portion and a peripheral skirt portion, a generally rectangular support frame for suspending the shadow mask by spot welding the peripheral skirt portion thereto, within the panel portion, a phosphor screen formed on an inner surface of the panel portion, an electron gun housed in the neck portion, and a deflection yoke mounted around a vicinity of a transitional region between the funnel portion and the neck portion for scanning electron beams from the electron gun on the phosphor screen, wherein the shadow mask is provided with a descending step portion extending along an entire outer edge of the imperforate portion, the peripheral skirt portion is formed by being bent back from an entire outer edge of the descending step portion, and the peripheral skirt portion is provided with a plurality of beads extending in a direction of a height of the peripheral skirt portion and protruding inward in each side of the peripheral skirt portion.

To accomplish the above object, a color cathode ray tube of another embodiment in accordance with the present invention comprises an evacuated envelope comprising a panel portion, a neck portion, and a funnel portion for connecting the panel portion and the neck portion, a generally rectangular shadow mask having a curved apertured portion having a multiplicity of electron-transmissive apertures, a curved imperforate portion surrounding and integral with the apertured portion and a peripheral skirt portion, a generally rectangular support frame for suspending the shadow mask by spot welding the peripheral skirt portion thereto, within the panel portion, a phosphor screen formed on an inner surface of the panel portion, an electron gun housed in the neck portion, and a deflection yoke mounted around a vicinity of a transitional region between the funnel portion and the neck portion for scanning electron beams from the electron gun on the phosphor screen, wherein the shadow mask is provided with a descending step portion extending along an entire outer edge of the imperforate portion, the peripheral skirt portion is formed by being bent back from an entire outer edge of the descending step portion, the peripheral skirt portion is provided with a plurality of beads extending in a direction of a height of the peripheral skirt portion and protruding inward in each side of the peripheral skirt portion, and one of following three conditions (a)–(c) is satisfied in regions outside each of central portions extending a distance SHL and a distance SVL in long and short sides of the peripheral skirt portion, respectively, (a) a height H of the descending step portion is in a range of 30% to 50% of H0, (b) a width W of the descending step portion is in a range of 65% to 80% of W0, and (c) a height H and a width W of the descending step portion are in a range of 30% to 50% of H0 and in a range of 65% to 80% of W0, respectively, SHL and SVL being 0.85 times lengths of the long and short sides of the peripheral skirt portion, respectively, H0 and W0 being a height H and a width W of the descending step portion at centerlines of the long and short sides of the peripheral skirt portion, respectively.

To accomplish the above object, a color cathode ray tube of still another embodiment in accordance with the present invention comprises an evacuated envelope comprising a panel portion, a neck portion, and a funnel portion for connecting the panel portion and the neck portion, a generally rectangular shadow mask having a curved apertured portion having a multiplicity of electron-transmissive apertures, a curved imperforate portion surrounding and integral with the apertured portion and a peripheral skirt portion, a generally rectangular support frame for suspending the shadow mask by spot welding the peripheral skirt portion thereto, within the panel portion, a phosphor screen formed on an inner surface of the panel portion, an electron gun housed in said neck portion, and a deflection yoke mounted around a vicinity of a transitional region between the funnel portion and the neck portion for scanning electron beams from the electron gun on the phosphor screen, wherein the shadow mask is provided with a descending step portion extending along an outer edge of the curved imperforate portion, the peripheral skirt portion is formed by being bent back from an outer edge of the descending step portion, the peripheral skirt portion is provided with a plurality of beads extending in a direction of a height of the peripheral skirt portion and protruding inward in each side of the peripheral skirt portion, and at least one of a height H and a width W of the descending step portion decreases progressively with distance from centerlines of long and short sides of the peripheral skirt portion in regions outside each of central portions extending a distance SHL and a distance SVL in long and short sides of the peripheral skirt portion, respectively, SHL and SVL being 0.9 times lengths of the long and short sides of the peripheral skirt portion, respectively.

In the present invention, since there is formed a plurality of beads extending in a direction of the height of the skirt portion and protruding inward in each of four sides of the skirt portion, in the operation of press-forming a mask blank into a unitary shadow mask structure, the maximum size of curls occurring in the skirt portion is reduced. Since there is also formed the descending step portion extending along the outer edge of the imperforate portion, even if great stress is caused to the skirt portion after the skirt portion has been fitted into the support frame and the great stress is transmitted to the imperforate portion from the skirt portion, the descending step portion relieves or blocks this great stress such that the great stress is not transmitted to the apertured portion and the curvature of the apertured portion is prevented from being deformed.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
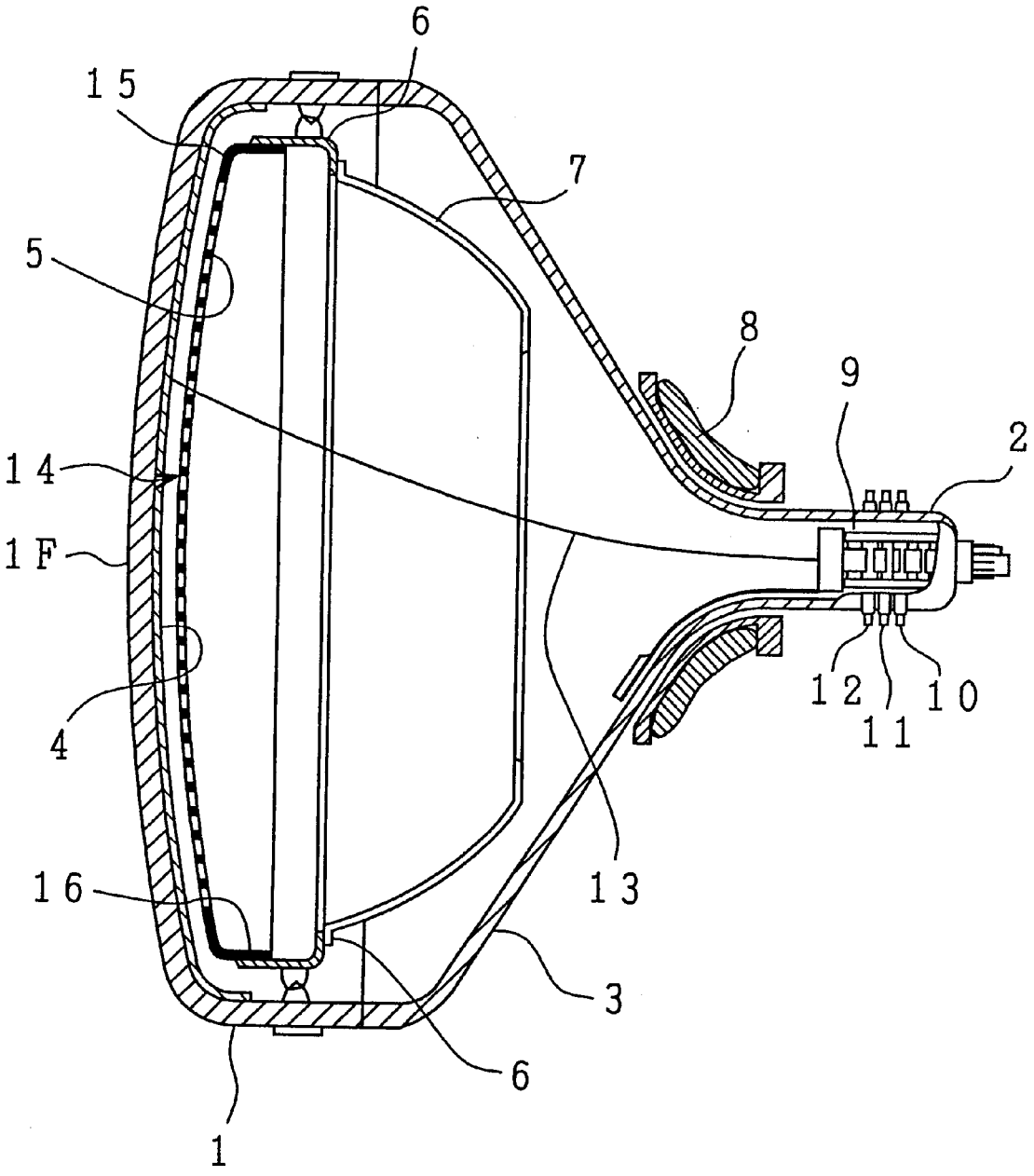
FIG. 1 is a schematic cross-sectional view of an embodiment of a shadow mask type color cathode ray tube in accordance with the present invention.

In an embodiment of a shadow mask type color cathode ray tube according to the present invention, a shadow mask is provided with a descending step portion extending along an entire outer edge of a curved imperforate portion surrounding a curved apertured portion having a multiplicity of electron-transmissive apertures, a peripheral skirt portion is formed by being bent back from an entire outer edge of the descending step portion, and the peripheral skirt portion is provided with a plurality of beads extending in a direction of a height of the peripheral skirt portion and protruding inward in each side of the peripheral skirt portion.

In another embodiment of a shadow mask type color cathode ray tube according to the present invention, a shadow mask is provided with a descending step portion extending along an entire outer edge of a curved imperforate portion surrounding a curved apertured portion having a multiplicity of electron-transmissive apertures, a peripheral skirt portion is formed by being bent back from an entire outer edge of the descending step portion, and the peripheral skirt portion is provided with a plurality of beads extending in a direction of a height of the peripheral skirt portion and protruding inward in each side of the peripheral skirt portion, one of following three conditions (a)–(c) is satisfied in regions outside each of central portions extending a distance SHL and a distance SVL in long and short sides of said peripheral skirt portion, respectively, (a) a height H of the descending step portion is in a range of 30% to 50% of H0, (b) a width w of the descending step portion is in a range of 65% to 80% of W0, and (c) a height H and a width W of the descending step portion are in a range of 30% to 50% of H0 and in a range of 65% to 80% of W0, respectively, SHL and SVL being 0.85 times the lengths of the long and short sides of the peripheral skirt portion, respectively, the H0 and the W0 being a height H and a width W of the descending step portion at the centerlines of the long and short sides of the peripheral skirt portion, respectively.

In still another embodiment of a shadow mask type color cathode ray tube according to the present invention, a shadow mask is provided with a descending step portion extending along an outer edge of a curved imperforate portion surrounding a curved apertured portion having a multiplicity of electron-transmissive apertures, a peripheral skirt portion is formed by being bent back from an outer edge of the descending step portion, and the peripheral skirt portion is provided with a plurality of beads extending in a direction of a height of the peripheral skirt portion and protruding inward in each side of the peripheral skirt portion, and at least one of a height H and a width W of the descending step portion decreases progressively with distance from the centerlines of the long and short sides of the peripheral skirt portion in regions outside each of central portions extending a distance SHL and a distance SVL in long and short sides of said peripheral skirt portion, respectively, the SHL and SVL being 0.9 times the lengths of the long and short sides of the peripheral skirt portion, respectively.

In a specific example of the first embodiment of the present invention, the height and the width of the descending step portion is about 1.5 mm and about 2.0 mm, respectively, and the maximum depth and the maximum width of the beads are about 1.0 mm and about 5.0 mm in an arcuate, triangular or rectangular cross-section. The beads are arranged symmetrically with respect to the centerline of each side of the skirt portion and are approximately evenly spaced on each side of the centerline.

In the above first embodiment of the present invention, in the operation of press-forming a mask blank having an apertured portion into a unitary shadow mask structure, since there is formed a plurality of beads extending in a direction of the height of the skirt portion and protruding inward in a substantially arcuate, substantially triangular or substantially rectangular cross-sectional configuration in each side of the skirt portion, the beads weaken the force of the skirt portion press-formed by bending to revert to its original form such that the maximum size of curls occurring in the skirt portion is reduced, and since there is also formed the descending step portion extending along the entire outer edge of the imperforate portion, even if great stress is caused to the skirt portion after the skirt portion has been fitted into the support frame and the stress is transmitted to the imperforate portion from the skirt portion, the descending step portion relieves or blocks this great stress such that the great stress is not transmitted to the apertured portion and the curvature of the apertured portion is prevented from being deformed. In this embodiment, the color selecting property of the shadow mask is not degraded and the mechanical strength of the shadow mask is improved.

The embodiments of the present invention will be described hereinafter with reference to the drawings. FIG. 1 is a schematic cross-sectional view of an embodiment of a shadow mask type color cathode ray tube in accordance with the present invention.

In FIG. 1, reference numeral 1 designates a panel portion, IF is a faceplate, 2 is a neck portion, 3 is a funnel portion, 4 is a phosphor screen, 5 is a shadow mask, 6 is a support frame, 7 is an internal magnetic shield, 8 is a deflection yoke, 9 is an in-line type electron gun, 10 is a color purity adjustment magnet, 11 is a four-pole magnet for static beam convergence adjustment, 12 is a six-pole magnet for static beam convergence adjustment, 13 is an electron beam, 14 is an apertured portion of the shadow mask 5, 15 is an imperforate portion of the shadow mask 5 and 16 is a skirt portion of the shadow mask 5.

An evacuated envelope (glass bulb) of the color cathode ray tube comprises the panel portion 1 having the generally rectangular faceplate IF, the elongated cylindrical neck portion 2 housing the in-line type electron gun 9 therein, and the funnel portion 3 joining the panel portion 1 and the neck portion 2. The phosphor film 4 is formed on the inner surface of the faceplate IF of the panel portion 1. The shadow mask 5 comprises the apertured portion 14, the imperforate portion 15 and the skirt portion 16, and is fixed to the support frame 6 by fitting its skirt portion 16 into the support frame 6 and spot welding the skirt portion to the support frame 6 which in turn is incorporated within the panel portion such that the apertured portion 14 of the shadow mask 5 opposes the phosphor screen 4. The internal magnetic shield 7 is disposed nearer to the panel portion 1 within the funnel portion 3, and the deflection yoke 8 is disposed nearer to the neck portion 2 and mounted around the funnel portion 3.

Externally of the neck portion 2 are juxtaposed the color purity adjustment magnet 10, the four-pole magnetic for static beam convergence adjustment 11, and the six-pole magnet 12 for static beam convergence adjustment. Three electron beams 13 (only one shown in FIG. 1) projected from the in-line type electron gun 9 are deflected in a desired direction by the deflection yoke 8, impinge upon the phosphor picture elements of the corresponding colors of the phosphor screen 4 through a large number of electron-transmissive apertures in the apertured portion 14 of the shadow mask 5 and reproduce the desired image on the phosphor screen 4.

The operation of the color cathode ray tube according to the present embodiment, that is, the image displaying operation is the same as that of the conventional color cathode ray tube of this kind, and such image displaying operation has been well known. Therefore, the description of the image displaying operation of the color cathode ray tube according to the present embodiment will be omitted.

Figure 2A:
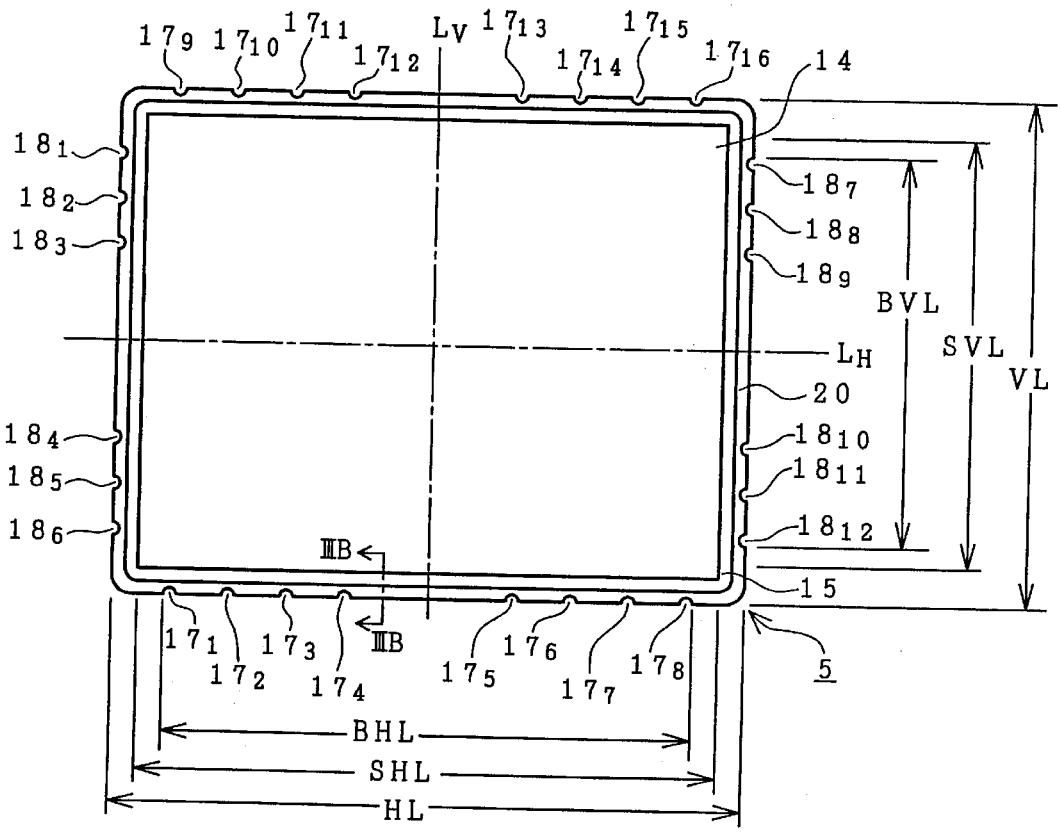
FIGS. 2A, 2B and 2C are illustrations for showing an embodiment of a shadow mask used for the color cathode ray tube shown in FIG. 1, FIG. 2A being a plan view thereof, FIG. 2B being a side view of a long side thereof, and FIG. 2C being an enlarged fragmentary plan view of a lower right-hand corner of the shadow mask of FIG. 2A.
Figure 2B:
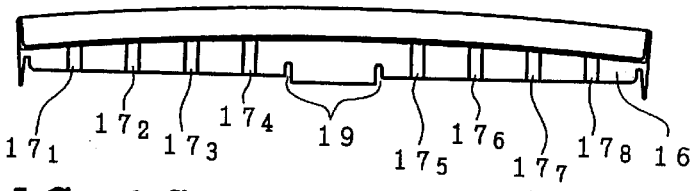
Figure 3A:
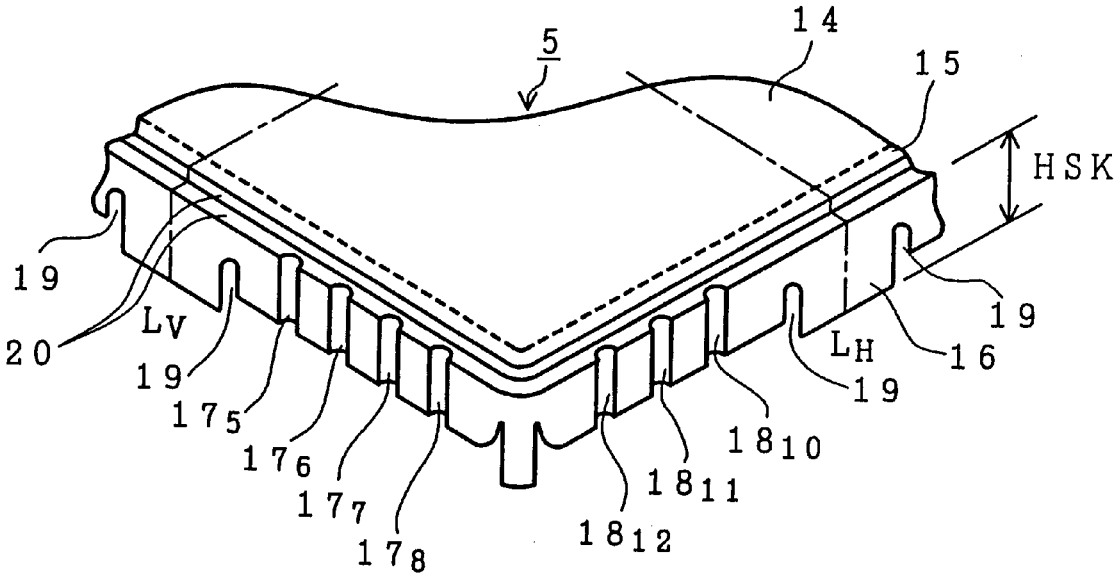
FIG. 3A is a perspective view of a corner and its vicinity of the embodiment shown in FIG. 2A.
Figure 3B:
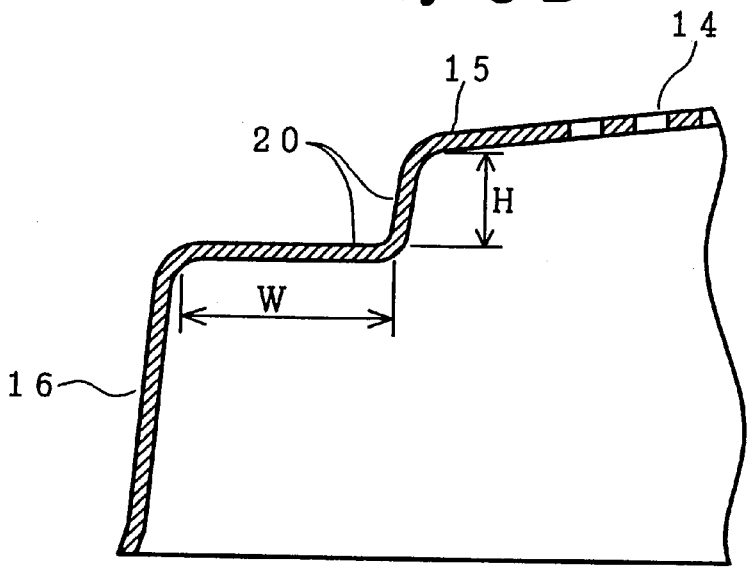
FIG. 3B is an enlarged fragmentary cross-sectional view taken along line IIIB—IIIB of FIG. 2A.
Figure 4A:
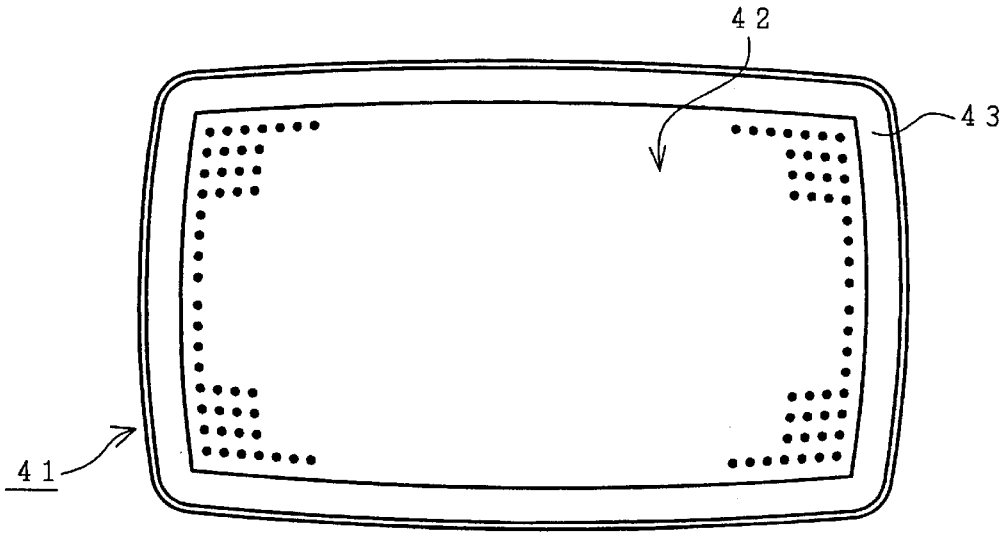
FIG. 4A (PRIOR ART)
FIGS. 4A, 4B and 4C are illustrations of a prior art shadow mask used for a color cathode ray tube, FIG. 4A being a plan view thereof, FIG. 4B being an enlarged fragmentary side view thereof and FIG. 4C being an enlarged fragmentary cross-sectional view thereof.
Figure 4B:
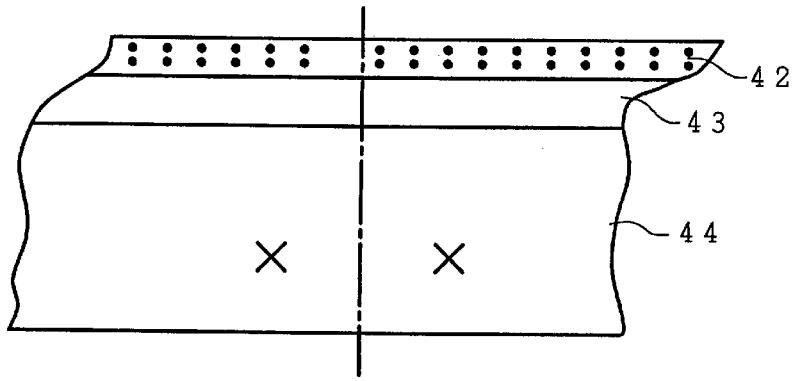
FIG. 4B (PRIOR ART)
Figure 4C:
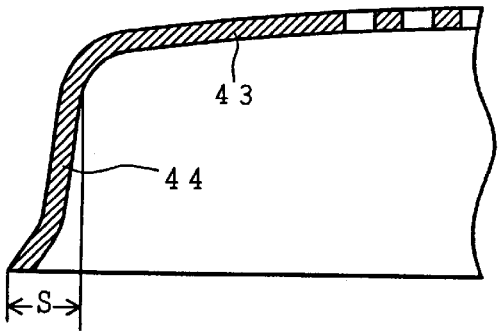
FIG. 4C (PRIOR ART)

FIGS. 2A, 2B, 3A and 3B are illustrations for showing an embodiment of a shadow mask 5 used for the color cathode ray tube shown in FIG. 1, FIG. 2A being a plan view thereof, FIG. 2B being a side view of a long side thereof, FIG. 3A being a perspective view of a corner and its vicinity thereof, and FIG. 3B being an enlarged fragmentary cross-sectional view taken along line IIIB—IIIB of FIG. 2A.

In FIGS. 2A, 2B, 3A and 3B, reference numerals $\mathbf{17}_1$, $\mathbf{17}_2$, $\mathbf{17}_3$, $\mathbf{17}_4$, $\mathbf{17}_5$, $\mathbf{17}_6$, $\mathbf{17}_7$, $\mathbf{17}_8$, $\mathbf{17}_9$, $\mathbf{17}_{10}$, $\mathbf{17}_{11}$, $\mathbf{17}_{12}$, $\mathbf{17}_{13}$, $\mathbf{17}_{14}$, $\mathbf{17}_{15}$ and $\mathbf{17}_{16}$ denote beads formed in long sides of the shadow mask 5, and reference numerals $\mathbf{18}_1$, $\mathbf{18}_2$ $\mathbf{18}_3$, $\mathbf{18}_4$, $\mathbf{18}_5$, $\mathbf{18}_6$, $\mathbf{18}_7$, $\mathbf{18}_8$, $\mathbf{18}_9$, $\mathbf{18}_{10}$, $\mathbf{18}_{11}$ and $\mathbf{18}_{12}$ denote beads formed in short sides of the shadow 5, reference numeral 19 denotes slits, reference numeral 20 denotes a descending step portion and the same reference numerals as utilized in FIG. 1 designate corresponding portions in FIGS. 2A, 2B, 3A and 3B.

The beads $\mathbf{17}_1$ to $\mathbf{17}_{16}$ formed in the two long sides of the skirt portion 16 extend along the entire height of the skirt portion 16 and protrude inward in an arcuate cross-sectional configuration. The four beads $\mathbf{17}_1$ to $\mathbf{17}_4$ are formed on one side (at the left in FIGS. 2A and 2B) of the center line LV in one long side of the shadow mask, the four beads $\mathbf{17}_5$ to $\mathbf{17}_8$ are formed on the other side (at the right in FIGS. 2A and 2B) of the center line LV in the one long side of the shadow mask. The four beads $\mathbf{17}_9$ to $\mathbf{17}_{12}$ are formed on the one side (at the left in FIGS. 2A and 2B) of the center line LV in the other long side of the shadow mask, the four beads $\mathbf{17}_{13}$ to $\mathbf{17}_{16}$ are formed on the other side (at the right in FIGS. 2A and 2B) of the center line LV in the other long side of the shadow mask.

The beads $\mathbf{18}_1$ to $\mathbf{18}_{12}$ formed in the two short sides of the skirt portion 16 extend along the entire height of the skirt portion 16 and protrude inward in an arcuate cross-sectional configuration. The three beads $\mathbf{18}_1$ to $\mathbf{18}_3$ are formed on one side (at the top in FIG. 2A) of the center line LH in one short side of the shadow mask, the three beads $\mathbf{18}_4$ to $\mathbf{18}_6$ are formed on the other side (at the bottom in FIGS. 2A) of the center line LH in the one short side of the shadow mask. The three beads $\mathbf{18}_7$ to $\mathbf{18}_9$ are formed on the one side (at the top in FIG. 2A) of the center line LH in the other short side of the shadow mask, the three beads $\mathbf{18}_{10}$ to $\mathbf{18}_{12}$ are formed on the other side (at the bottom in FIG. 2A) of the center line LH in the other short side of the shadow mask.

For the purpose of reducing the size of curls, the slits 19 are formed to extend a predetermine distance from the bottom end of the skirt portion 16 in a direction of the height of the skirt portion 16 and one slit is disposed on each side of the centerline LV of each long side of the shadow mask and one slit is disposed on each side of the centerline LH of each short side of the shadow mask.

The descending step portion 20 extends along the entire outer edge of the imperforate portion 15 of the shadow mask 5, that is, along its entire edge of the imperforate portion 15 on the skirt portion 16 side thereof such that a peripheral portion of the imperforate portion 15 is recessed by one step abruptly from the otherwise approximately gradually sloped surface. The skirt portion 16 is formed by being bent back from an outer edge of the descending step portion 20.

As a specific example for an apertured area 14 of about 365 mm in width and about 275 mm in height of the shadow mask for use in a color cathode ray tube having a panel portion 1 of a 19-inch outside diagonal, the size and location of the beads $\mathbf{17}_1$ to $\mathbf{17}_{16}$ formed in the long sides and the beads $\mathbf{18}_1$ to $\mathbf{18}_{12}$ formed in the short sides of the skirt portion 16, the size and location of the slits 19 formed in the long and short sides and the dimensions of the descending step portion 20 formed in the imperforate portion 15 are as follows.

Figure 2C:
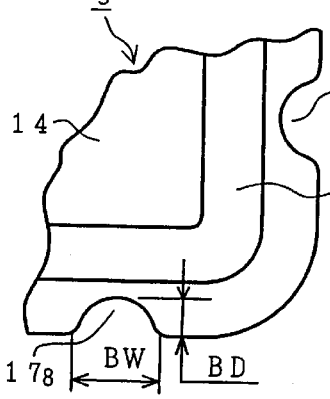

The maximum depth BD and the maximum width BW of the beads $\mathbf{17}_1$ to $\mathbf{17}_{16}$ in the long sides and of the beads $\mathbf{18}_1$ to $\mathbf{18}_{12}$ in the short sides shown in FIG. 2C are about 1.0 mm and about 5.0 mm, respectively, and the width and the length of the slits 19 are about 3 mm and about 3 mm, respectively. The step height H and the width W of the descending step portion 20 are about 1.5 mm and about 2.0 mm, respectively. The mask blank for the shadow mask 5 is made of an Invar (trademark, iron-nickel alloy) sheet of 0.13 mm in thickness. The skirt height HSK in FIG. 3A is 17 mm.

It is preferable that a height and a width of the descending step portion are in a range of 1 mm to 2 mm and in a range of 1 mm to 3 mm, respectively, a cross-section of the beads is 4 mm to 12 mm in width and 0.2 mm to 1.5 mm in depth.

It is preferable that a plurality of beads are distributed over each of central portions extending a distance BHL and a distance BVL in long and short sides of the skirt portion, respectively, BHL and BVL satisfying the following inequalities:

$$0.5HL \leqq BHL \leqq 0.85HL,$$

$$0.5VL \leqq BVL \leqq 0.85VL,$$

and HL and VL being the longitudinal lengths of the long and short sides of the skirt portion, respectively (see FIG. 2A).

Each of the two slit 19 in each of the two long sides is spaced about 25 mm from the centerline LV of the long sides on each side of the centerline LV, and each of the two slit 19 in each of the two short sides is spaced about 25 mm from the centerline LH of the short sides on each side of the centerline LH.

The beads $\mathbf{17}_1$ to $\mathbf{17}_{16}$ formed in the two long sides are arranged such that eight of the beads are disposed symmetrically with respect to the centerline LV of the long sides in each long side, four beads being disposed on each side of the centerline LV and being spaced about 35 mm from adjacent beads on each side of the centerline LV.

The beads $\mathbf{18}_1$ to $\mathbf{18}_{12}$ formed in the two short sides are arranged such that six of the beads are disposed symmetrically with respect to the centerline LH of the short sides on each short side, three beads being disposed on each side of the centerline LH and being spaced about 25 mm from adjacent beads on each side of the centerline LH.

The slits 19 disposed adjacent to the centerline LV in the long sides are spaced about 20 mm from respective adjacent ones of the beads $\mathbf{17}_4$, $\mathbf{17}_5$, $\mathbf{17}_{12}$, $\mathbf{17}_{13}$ in the long sides, and the slits 19 disposed adjacent to the centerline LH in the short sides are spaced about 20 mm from respective adjacent ones of the beads $\mathbf{18}_3$, $\mathbf{18}_4$, $\mathbf{18}_9$, $\mathbf{18}_{10}$ in the short sides.

The beads $\mathbf{17}_1$ to $\mathbf{17}_{16}$ in the long sides, the beads $\mathbf{18}_1$ and $\mathbf{18}_{12}$ in the short sides, of the skirt portion 16 and the descending step portion 20 in the imperforate portion 15 are formed simultaneously with the skirt portion 16 in the operation of press-forming a thin mask blank into the shadow mask 5, and therefore no additional process step is needed for formation of the beads $\mathbf{17}_1$ to $\mathbf{17}_{16}$ in the long sides, the beads $\mathbf{18}_1$ and $\mathbf{18}_{12}$ in the short sides and the descending step portion 20 in the imperforate portion 15.

The shadow mask 5 of the above structure is provided with the beads $\mathbf{17}_1$ to $\mathbf{17}_{16}$ in the long sides, the beads $\mathbf{18}_1$ and $\mathbf{18}_{12}$ in the short sides, of the skirt portion 16 and consequently the shadow mask 5 can limit the maximum size of curls occurring in the skirt portion 16 of the press-formed shadow mask 5 to a specified value smaller than a shadow mask without any beads in the long and short sides of its skirt portion.

The shadow mask 5 having reduced the maximum size S of curls in the skirt portion 16 enables the operation of fitting its skirt portion 16 into the support frame 6 easily to obtain a shadow mask assembly, and enables the operation of spot welding the skirt portion 16 to the support frame 6 at portions of the skirt portion 16 inserted within the support frame 6, that is, the workability in fitting the skirt portion 16 into the support frame 6 is improved.

Since the shadow mask 5 of the above structure is provided with the descending step portion 20 in the imperforate portion 15, and even if relatively great stress is accidentally caused to the skirt portion 16 after the skirt portion 16 has been fitted into the support frame 6 and the stress is transmitted to the imperforate portion 15 from the skirt portion 16, the descending step portion 20 blocks transmission of this stress from the imperforate portion 15 to the apertured portion 14.

A prior art technique of reinforcing the skirt portion by using vertically-extending beads only had a problem that rigidity is increased locally in the immediate vicinity of the beads and consequently local cave-in occurs in the press-formed apertured portion. Without the reinforcing beads, the increase of the size of curls occurring in the skirt portion is inevitable, resulting in deformation of the curvature of the assembled shadow mask greater than that incurred by the beads. Combination of vertically-extending beads and the descending step portion surrounding the apertured portion reduces or eliminates the curls of the skirt portion, and also eliminates deformation of the press-formed apertured portion by absorbing the stress transferring from the skirt portion toward the apertured portion with the descending step portion.

Therefore the curvature of the apertured portion 14 is prevented from being deformed by the stress, the mechanical strength of the shadow mask 5 is not degraded and the color selecting property of the shadow mask 5 is not deteriorated.

There is a possibility that excessive stretching of the material in the apertured portion occurs in the corners of a shadow mask in the operation of forming a mask blank into the shadow mask such that two adjacent electron-transmissive apertures in the apertured portion are elongated to be joined together, and this possibility is enhanced by the reinforcing beads. The following two embodiments intend to weaken the strength of the corners and to eliminate the excessive stretching of the material in the apertured portion in the corners of the shadow mask.

Figure 5:
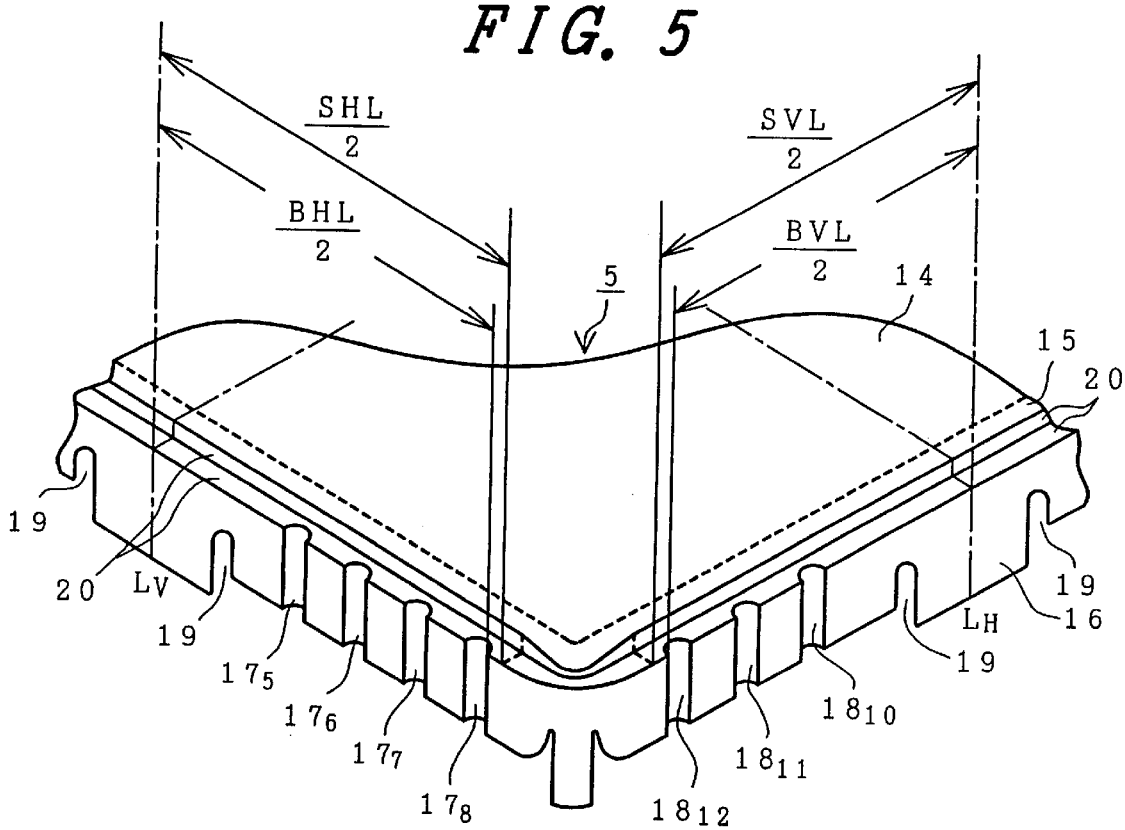
FIG. 5 is a perspective view of a corner and its vicinity of another embodiment of the present invention.

FIG. 5 is a perspective view of an embodiment having an improved structure of the descending step portion 20.

In FIG. 5, when the height and the width of the descending step portion 20 at centerlines LV, LH of the long and short sides are H0 and W0, respectively, the height H and the width W of the descending step portion 20 are in a range of 30% to 50% of H0 and in a range of 65% to 80% of W0 in regions outside each of central portions extending a distance SHL and a distance SVL in long and short sides of the peripheral skirt portion, respectively, the SHL and SVL being 0.85 times the lengths HL, VL of the long and short sides of the peripheral skirt portion, respectively (see FIG. 2A).

It is preferable that H0 and W0 are in a range of 1 mm to 2 mm and in a range of 1 mm to 3 mm, respectively.

In this embodiment the shadow mask is identical in structure with the embodiment described in connection with FIGS. 2A to 2C, 3A and 3B, except for the structure of the descending step portion 20.

In the above embodiment, both the height H and the width W of the descending step portion 20 are reduced to a range of 30% to 50% of H0 and to a range of 65% to 80% of W0, respectively, in the regions outside each of central portions extending the distance SHL and the distance SVL in the long and short sides of the peripheral skirt portion, respectively. But, depending upon the size of the shadow mask, both the height H and the width W of the descending step portion 20 need not be reduced to a range of 30% to 50% of H0 and to a range of 65% to 80% of W0 in the regions outside each of central portions extending the distance SHL and the distance SVL, and only one of the height H and the width W of the descending step portion 20 may be reduced to the above-mentioned ranges in regions outside each of the central portions.

Figure 6:
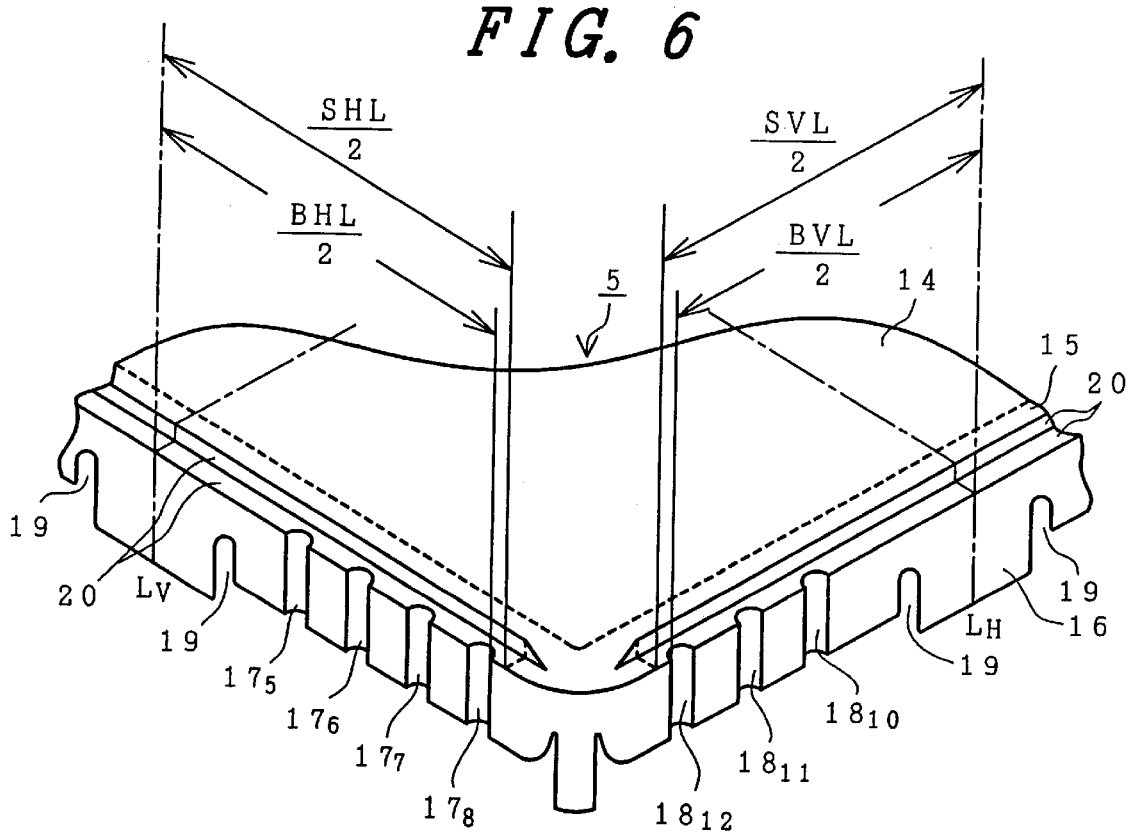
FIG. 6 is a perspective view of a corner and its vicinity of still another embodiment of the present invention.

FIG. 6 is a perspective view of another embodiment having an improved structure of the descending step portion 20.

In FIG. 6, the height H and the width W of the descending step portion 20 decrease progressively with distance from the centerlines LV, LH of the long and short sides of the peripheral skirt portion in regions outside each of central portions extending a distance SHL and a distance SVL in long and short sides of the peripheral skirt portion, respectively, the SHL and SVL being 0.9 times the lengths HL, VL, of the long and short sides of the peripheral skirt portion, respectively (see FIG. 2A).

In this embodiment, the height H and the width W of the descending step portion 20 decrease to approximately zero at four corners of the peripheral skirt portion, but it is not essential that the height H and the width W of the descending step portion 20 decrease to approximately zero at the four corners of the peripheral skirt portion, but it is sufficient that the height H and the width W of the descending step portion 20 decrease enough to eliminate the excessive stretching of the material in the apertured portion in the corners of the shadow mask.

It is preferable that the height H0 and the width W0 of the descending step portion 20 at centerlines LV, LH of the long and short sides are in a range of 1 mm to 2 mm and in a range of 1 mm to 3 mm, respectively.

In this embodiment the shadow mask is identical in structure with the embodiment described in connection with FIGS. 2A to 2C, 3A and 3B, except for the structure of the descending step portion 20.

In the above embodiment, both the height H and the width W of the descending step portion 20 decrease progressively with distance from the centerlines LV, LH of the long and short sides of the peripheral skirt portion in the regions outside each of central portions extending the distance SHL and the distance SVL in the long and short sides of the peripheral skirt portion, respectively. But, depending upon the size of the shadow mask, both the height H and the width W of the descending step portion 20 need not decrease progressively with distance from the centerlines LV, LH of the long and short sides of the peripheral skirt portion in the regions outside each of central portions extending the distance SHL and the distance SVL in the long and short sides of the peripheral skirt portion, respectively, and only one of the height H and the width W of the descending step portion 20 may decrease progressively with distance from the centerlines LV, LH of the long and short sides of the peripheral skirt portion in the regions outside each of central portions extending the distance SHL and the distance SVL in the long and short sides of the peripheral skirt, respectively.

In the above embodiments, the shadow mask 5 is explained by using an example of a color cathode ray tube having the panel portion 1 of a 19-inch outside diagonal, but the shadow mask 5 of the present invention is not limited to the use in the color cathode ray tube having the panel portion 1 of a 19-inch outside diagonal, and can be used in color cathode ray tubes having the panel portion 1 of outside diagonals other than 19 inches.

In the above embodiments, the shadow mask 5 is used in a color cathode ray tube having the panel portion 1 of a 19-inch outside diagonal, and the specific dimensions of the beads, the specific number of the beads, the specific spacings between two adjacent beads in the long and short sides of the skirt portion 16 and the specific dimensions of the descending step portion 20 are explained, but the dimensions of the beads, the number of the beads, the spacings between two adjacent beads in the long and short sides of the skirt portion and the dimensions of the descending step portion in the present invention are not limited to the above-indicated specific values, but they can be selected properly for each application, even when the present invention is applied to a 19-inch diagonal color cathode ray tube, but they can be selected properly for each application. When the present invention is applied to a color cathode ray tube of a diagonal other than 19 inches, naturally the dimensions of the beads, the number of the beads, the spacings between two adjacent beads in the long and short sides of the skirt portion and the dimensions of the descending step portion in the present invention can be selected properly for each type of color cathode ray tubes.

Figure 2D:
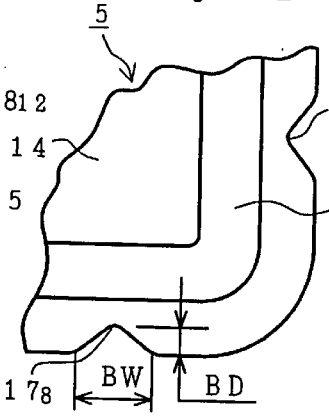
FIGS. 2D and 2E are enlarged fragmentary plan views of alternative beads used in the present invention.
Figure 2E:
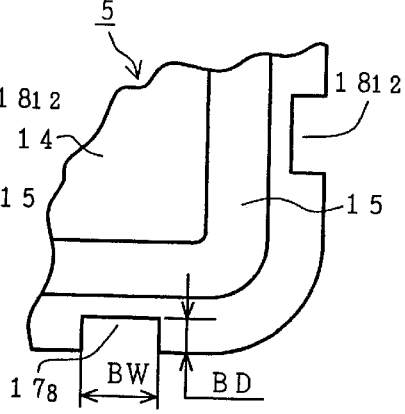

In the above embodiments, the beads $\mathbf{17}_1$ to $\mathbf{17}_{16}$ formed in the long sides of the skirt portion 16 and the beads $\mathbf{18}_1$ to $\mathbf{18}_{12}$ formed in the short sides of the skirt portion 16 protrude inward in an arcuate cross-sectional configuration as shown in FIG. 2C, but the cross-sectional configuration of the beads formed in the long and short sides of the skirt portion in accordance with the present invention is not limited to an arcuate one, it can be a triangular or rectangular one as shown in FIGS. 2D and 2E to obtain the advantages such as explained above.

In the present invention, since there is formed a plurality of beads extending in a direction of the height of the skirt portion and protruding inward in an arcuate, triangular or rectangular cross-sectional configuration in each of four sides of the skirt portion, in the operation of press-forming a mask blank into a unitary shadow mask structure, the beads weaken the force of the bent skirt portion to revert to its original form such that the maximum size of curls occurring in the skirt portion is reduced.

In the present invention, since there is also formed the descending step portion extending along the entire outer edge of the imperforate portion, even if great stress is caused to the skirt portion after the skirt portion has been fitted into the support frame and the great stress is transmitted to the imperforate portion from the skirt portion, the descending step portion relieves or blocks this great stress such that the great stress is not transmitted to the apertured portion and the curvature of the apertured portion is prevented from being deformed.

In the present invention, since the curvature of the apertured portion is not deformed, the color selecting property of the shadow mask is not degraded and the mechanical strength of the shadow mask is improved.

What is claimed is:

1. A color cathode ray tube comprising an evacuated envelope comprising a panel portion, a neck portion, and a funnel portion for connecting said panel portion and said neck portion, a generally rectangular shadow mask having a curved apertured portion having a multiplicity of electron-transmissive apertures, a curved imperforate portion surrounding and integral with said apertured portion and a peripheral skirt portion, a generally rectangular support frame for suspending said shadow mask by spot welding said peripheral skirt portion thereto, within said panel portion, a phosphor screen formed on an inner surface of said panel portion, an electron gun housed in said neck portion, and a deflection yoke mounted around a vicinity of a transitional region between said funnel portion and said neck portion for scanning electron beams from said electron gun on said phosphor screen, wherein said shadow mask is provided with a descending step portion extending along an entire outer edge of said imperforate portion, said peripheral skirt portion is formed by being bent back from an entire outer edge of said descending step portion, and said peripheral skirt portion is provided with a plurality of beads extending in a direction of a height of said peripheral skirt portion and protruding inward in each side of said peripheral skirt portion.

2. A color cathode ray tube comprising an evacuated envelope comprising a panel portion, a neck portion, and a funnel portion for connecting said panel portion and said neck portion, a generally rectangular shadow mask having a curved apertured portion having a multiplicity of electron-transmissive apertures, a curved imperforate portion surrounding and integral with said apertured portion and a peripheral skirt portion, a generally rectangular support frame for suspending said shadow mask by spot welding said peripheral skirt portion thereto, within said panel portion, a phosphor screen formed on an inner surface of said panel portion, an electron gun housed in said neck portion, and a deflection yoke mounted around a vicinity of a transitional region between said funnel portion and said neck portion for scanning electron beams from said electron gun on said phosphor screen, wherein said shadow mask is provided with a descending step portion extending along an entire outer edge of said imperforate portion, said peripheral skirt portion is formed by being bent back from an entire outer edge of said descending step portion, said peripheral skirt portion is provided with a plurality of beads extending in a direction of a height of said peripheral skirt portion and protruding inward in each side of said peripheral skirt portion, and one of following three conditions (a)–(c) is satisfied in regions outside each of central portions extending a distance SHL and a distance SVL in long and short sides of said peripheral skirt portion, respectively, (a) a height H of said descending step portion is in a range of 30% to 50% of H0, (b) a width W of said descending step portion is in a range of 65% to 80% of W0, and (c) a height H and a width W of said descending step portion are in a range of 30% to 50% of H0 and in a range of 65% to 80% of W0, respectively, said SHL and SVL being 0.85 times lengths of said long and short sides of said peripheral skirt portion, respectively, said H0 and said W0 being a height H and a width W of said descending step portion at centerlines of said long and short sides of said peripheral skirt portion, respectively.

3. A color cathode ray tube comprising an evacuated envelope comprising a panel portion, a neck portion, and a funnel portion for connecting said panel portion and said neck portion, a generally rectangular shadow mask having a curved apertured portion having a multiplicity of electron-transmissive apertures, a curved imperforate portion surrounding and integral with said apertured portion and a peripheral skirt portion, a generally rectangular support frame for suspending said shadow mask by spot welding said peripheral skirt portion thereto, within said panel portion, a phosphor screen formed on an inner surface of said panel portion, an electron gun housed in said neck portion, and a deflection yoke mounted around a vicinity of a transitional region between said funnel portion and said neck portion for scanning electron beams from said electron gun on said phosphor screen, wherein said shadow mask is provided with a descending step portion extending along an outer edge of said curved imperforate portion, said peripheral skirt portion is formed by being bent back from an outer edge of said descending step portion, said peripheral skirt portion is provided with a plurality of beads extending in a direction of a height of said peripheral skirt portion and protruding inward in each side of said peripheral skirt portion, and at least one of a height H and a width W of said descending step portion decreases progressively with distance from centerlines of long and short sides of said peripheral skirt portion in regions outside each of central portions extending a distance SHL and a distance SVL in long and short sides of said peripheral skirt portion, respectively, said SHL and SVL being 0.9 times lengths of said long and short sides of said peripheral skirt portion, respectively.

4. A color cathode ray tube according to claim 1, wherein a height and a width of said descending step portion are in a range of 1 mm to 2 mm and in a range of 1 mm to 3 mm, respectively.

5. A color cathode ray tube according to claim 1, wherein a cross section of said plurality of beads is 4 mm to 12 mm in width and 0.2 mm to 1.5 mm in depth.

6. A color cathode ray tube according to claim 1, wherein said plurality of beads are arranged symmetrically with respect to centerlines of long and short sides of said peripheral skirt portion, respectively, and are approximately evenly spaced on each side of said centerlines.

7. A color cathode ray tube according to claim 1, wherein said plurality of beads protrude in one of arcuate, triangular and rectangular cross sections.

8. A color cathode ray tube according to claim 2, wherein said H0 and said W0 are in a range of 1 mm to 2 mm and in a range of 1 mm to 3 mm, respectively.

9. A color cathode ray tube according to claim 2, wherein a cross section of said plurality of beads is 4 mm to 12 mm in width and 0.2 mm to 1.5 mm in depth.

10. A color cathode ray tube according to claim 2, wherein said plurality of beads are arranged symmetrically with respect to said centerlines of said long and short sides of said peripheral skirt portion, respectively, and are approximately evenly spaced on each side of said centerlines.

11. A color cathode ray tube according to claim 2, wherein said plurality of beads protrude in one of arcuate, triangular and rectangular cross-sections.

12. A color cathode ray tube according to claim 3, wherein a height H and a width W of said descending step portion at said centerlines of said long and short sides of said peripheral skirt portion, respectively, are in a range of 1 mm to 2 mm and in a range of 1 mm to 3 mm, respectively.

13. A color cathode ray tube according to claim 3, wherein a cross section of said plurality of beads is 4 mm to 12 mm in width and 0.2 mm to 1.5 mm in depth.

14. A color cathode ray tube according to claim 3, wherein said plurality of beads are arranged symmetrically with respect to said centerlines of said long and short sides of said peripheral skirt portion, respectively, and are approximately evenly spaced on each side of said centerlines.

15. A color cathode ray tube according to claim 3, wherein said plurality of beads protrude in one of arcuate, triangular and rectangular cross sections.

16. A color cathode ray tube according to claim 3, wherein said height H of said descending step portion decreases to approximately zero at four corners of said peripheral skirt portion.

17. A color cathode ray tube according to claim 3, wherein said width W of said descending step portion decreases to approximately zero at four corners of said peripheral skirt portion.

18. A color cathode ray tube according to claim 3, wherein said height H and said width W of said descending step portion decrease to approximately zero at four corners of said peripheral skirt portion.

19. A color cathode ray tube according to claim 1, wherein said plurality of beads are distributed over each of central portions extending a distance BHL and a distance BVL in long and short sides of said skirt portion, respectively, said BHL and BVL satisfying following inequalities:

$$0.5HL \leqq BHL \leqq 0.85HL,$$

$$0.5VL \leqq BVL \leqq 0.85VL, \text{ and}$$

said HL and VL being longitudinal lengths of said long and short sides of said skirt portion, respectively.

20. A color cathode ray tube according to claim 2, wherein said plurality of beads are distributed over each of central portions extending a distance BHL and a distance BVL in said long and short sides of said skirt portion, respectively, said BHL and BVL satisfying following inequalities:

$$0.5HL \leqq BHL \leqq 0.85HL,$$

$$0.5VL \leqq BVL \leqq 0.85VL., \text{ and}$$

said HL and VL being longitudinal lengths of said long and short sides of said skirt portion, respectively.

21. A color cathode ray tube according to claim 3, wherein said plurality of beads are distributed over each of central portions extending a distance BHL and a distance BVL in said long and short sides of said skirt portion, respectively, said BHL and BVL satisfying following inequalities:

$$0.5HL \leqq BHL \leqq 0.85HL,$$

$$0.5VL \leqq BVL \leqq 0.85VL, \text{ and}$$

said HL and VL being longitudinal lengths of said long and short sides of said skirt portion, respectively.

22. A color cathode ray tube according to claim 1, wherein a pair of slits are disposed one on each side of a centerline of each of long and short sides of said skirt portion.

23. A color cathode ray tube according to claim 2, wherein a pair of slits are disposed one on each side of a centerline of each of said long and short sides of said skirt portion.

24. A color cathode ray tube according to claim 3, wherein a pair of slits are disposed one on each side of a centerline of each of said long and short sides of said skirt portion.

* * * * *